US006231387B1

(12) United States Patent
Kameyama

(10) Patent No.: US 6,231,387 B1
(45) Date of Patent: May 15, 2001

(54) COAXIAL CABLE CONNECTOR AND METHOD OF ASSEMBLING THE SAME

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/593,156

(22) Filed: Jun. 14, 2000

(30) Foreign Application Priority Data

Jun. 15, 1999 (JP) ..... 11-168622

(51) Int. Cl.[7] ..... H01R 9/05
(52) U.S. Cl. ..... 439/578; 439/394; 439/467
(58) Field of Search ..... 439/578, 579, 439/580, 581, 582, 585, 852, 874, 394, 467, 597

(56) References Cited

U.S. PATENT DOCUMENTS 4,310,719 * 1/1982 Cross et al. ..... 439/874
5,766,036 * 6/1998 Ahmad et al. ..... 439/610
5,879,190 * 3/1999 Maruyama et al. ..... 439/582

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

A terminal includes a connecting portion having a through hole to which a core wire of the coaxial cable is inserted to be electrically connected therewith, and a flat projection formed in the vicinity of the through hole on the connecting portion. The connecting portion is formed as a vertical wall member extending perpendicular to an insertion direction of the coaxial cable, and the flat projection is formed as a horizontal table member projected therefrom so as to extend parallel with the insertion direction of the coaxial cable. A corner portion defined by the vertical wall member and the horizontal table portion is utilized for a portion where a leading end of a soldering iron for soldering the connecting portion and the core wire is abutted.

6 Claims, 6 Drawing Sheets

COAXIAL CABLE CONNECTOR AND METHOD OF ASSEMBLING THE SAME

BACKGROUND OF THE INVENTION

The present invention relates to a coaxial cable connector and a method for assembling the same connector and in particular to a technique for improving in particular the workability in soldering a core wire at the time of assembly.

A related coaxial cable connector will be explained with reference to FIGS. 6 and 7. In the construction of a coaxial cable connector shown in FIG. 6, a terminal 72 is provided at a leading end of a terminal holder 71 formed from an insulating material, and with one of two-part lids 73 being closed which are provided at the leading end of the holder 71 in such a manner as to be opened and/or closed via an integral hinge or the like, a shield cover 74 is attached to the external circumference of the holder 71, the shield cover 74 being constructed so as to extend as far as a leading end a coaxial cable 50 in such a manner as to cover the outer circumference of the one of the lids 73 which is closed.

A method for assembling the connector constructed as described above to the coaxial cable 50 comprises, as shown in FIG. 6, the steps of allowing a core wire 52 of the coaxial cable 50 to pass through a connecting hole 72*a* formed in a vertical wall at the leading end of the terminal 72, applying a soldering iron 60 to this portion for soldering, thereafter closing the other lid 73, introducing a sleeve 79 over the outer circumference of the holder 71 as shown in FIG. 7, and a clamping members 79*a* at a leading end of the sleeve 79 are clamped to secure the sleeve 79 with the coaxial cable 50 for completion of the assembly.

With the coaxial cable connector constructed as described above, however, since soldering has to be carried out with respect to the surface extending vertically, it is difficult to apply the soldering iron to the proper position needing soldering, and in addition, it is also difficult to secure a leading end of the soldering iron 60 during the soldering. Thus, there is caused a problem that the workability in soldering tend to be reduced.

In addition, in a case where fused solder is sagged on the insulator (the lid 73 or the like) to thereby open a hole in the insulator, there is caused a concern of short circuit when a bent portion is provided to the core wire 52 as shown in FIG. 1.

SUMMARY OF THE INVENTION

The present invention was made in view of the aforesaid problems and an object thereof is to provide a coaxial cable connector which can improve the workability in soldering by making it possible for the leading end of the soldering iron to be stably fixed to a soldering surface at the time of soldering and which is free from a risk of sagging of fused solder and a method for assembling the same connector to a coaxial cable.

In order to achieve the above object, there is provided a connector for a coaxial cable comprising:

a terminal including:

- a connecting portion having a through hole to which a core wire of the coaxial cable is inserted to be electrically connected therewith; and
- a flat projection formed in the vicinity of the through hole on the connecting portion; and
- a terminal holder made of an insulating material for accommodating the terminal.

Preferably, the connecting portion is formed as a vertical wall member extending perpendicular to an insertion direction of the coaxial cable, and the flat projection includes a horizontal table member projected therefrom so as to extend parallel with the insertion direction of the coaxial cable.

According to the above configuration, soldering can be carried out with the leading end of the soldering iron being stably supported on the horizontal table member and the workability in soldering can be improved, thereby making it possible to perform soldering work quickly and with high quality. In addition, since fused solder is received by the horizontal table member, sagging of fused solder can be prevented, whereby a risk of generation of short circuit can be prevented.

Preferably, the terminal holder includes a lid body for opening/closing a space where the connecting portion is located. A soldering iron is inserted into the space formed by opening the lid body to solder the connecting portion and the core wire.

According to the above configuration, the soldering iron for performing soldering work is placed on the horizontal table member through the space opened by the lid body, whereby the workability in soldering can be improved.

Preferably, a part of the vertical wall member is cut and erected to form the horizontal table member. The terminal holder has a projection on an inner wall thereof, which is engaged with an opening formed on the connecting portion due to the formation of the horizontal table member.

According to the above configuration, there is no need to provide a separate table member for assembly, a construction being thus provided which is simple and free from wastefulness.

Preferably, a corner portion defined by the vertical wall member and the horizontal table portion is utilized for a portion where a leading end of a soldering iron for soldering the connecting portion and the core wire is abutted.

According to the above configuration, since soldering work can be performed with the leading end of the soldering iron being supported on the table portion, the workability in soldering can be improved and soldering work can be carried out quickly and with high quality.

DETAILED DESCRIPTION OF THE PREFERRED EMBODIMENTS

Referring to the accompanying drawings, a coaxial cable connector and a method for assembling the same according to one embodiment of the invention will be described in detail below.

Figure 1:
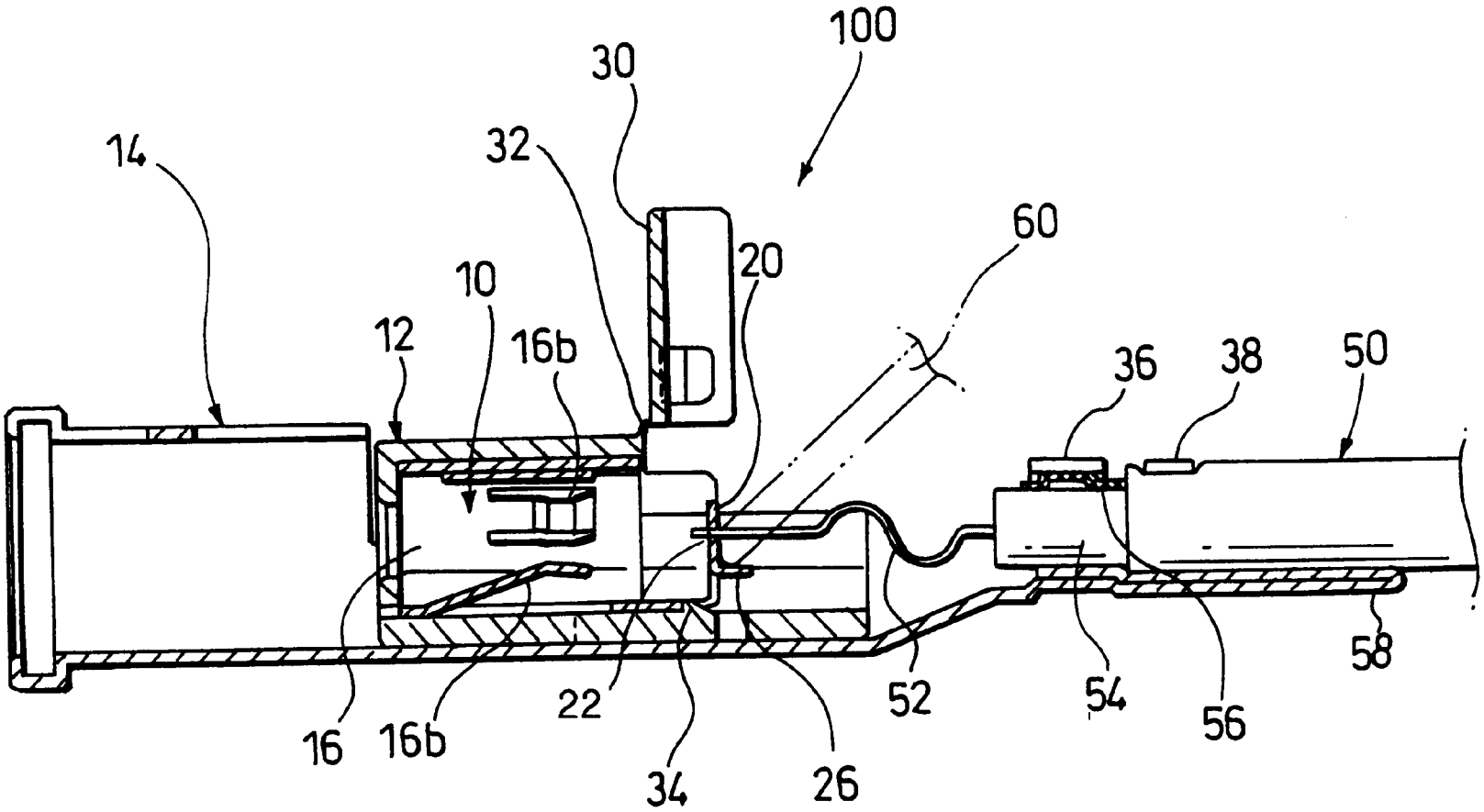
FIG. 1 is a sectional view of a coaxial cable connector according to one embodiment of the invention.
Figure 2A:
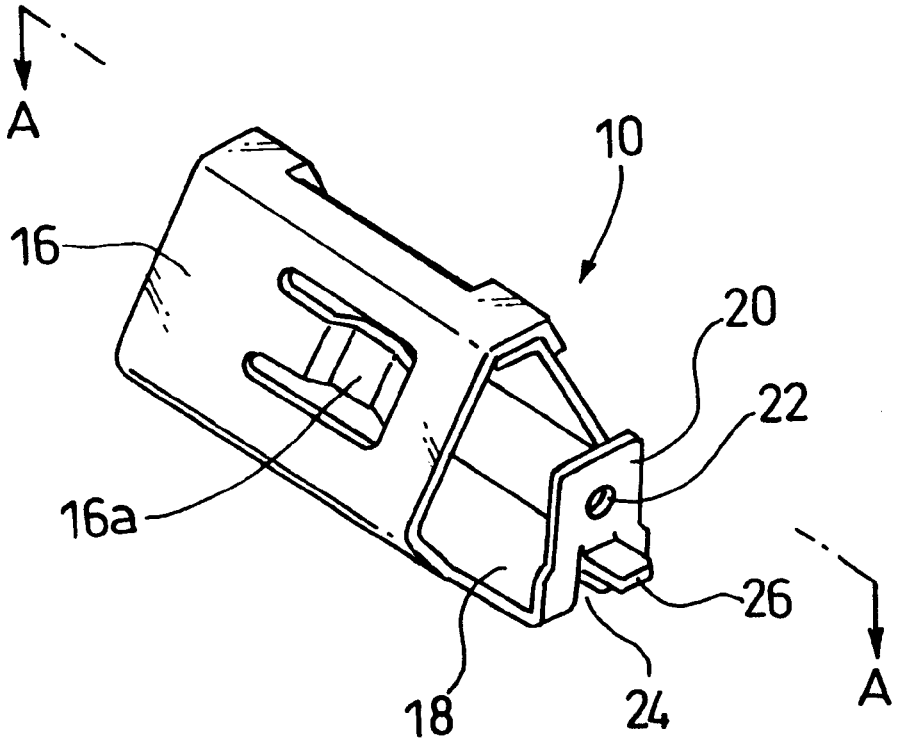
FIG. 2A is a perspective view showing a terminal of the coaxial cable connector.
Figure 2B:
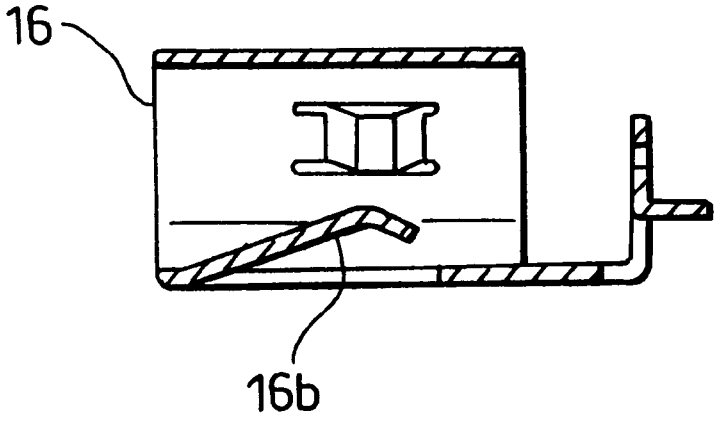
FIG. 2B is a sectional view taken along the line A—A of FIG. 2A.
Figure 3A:
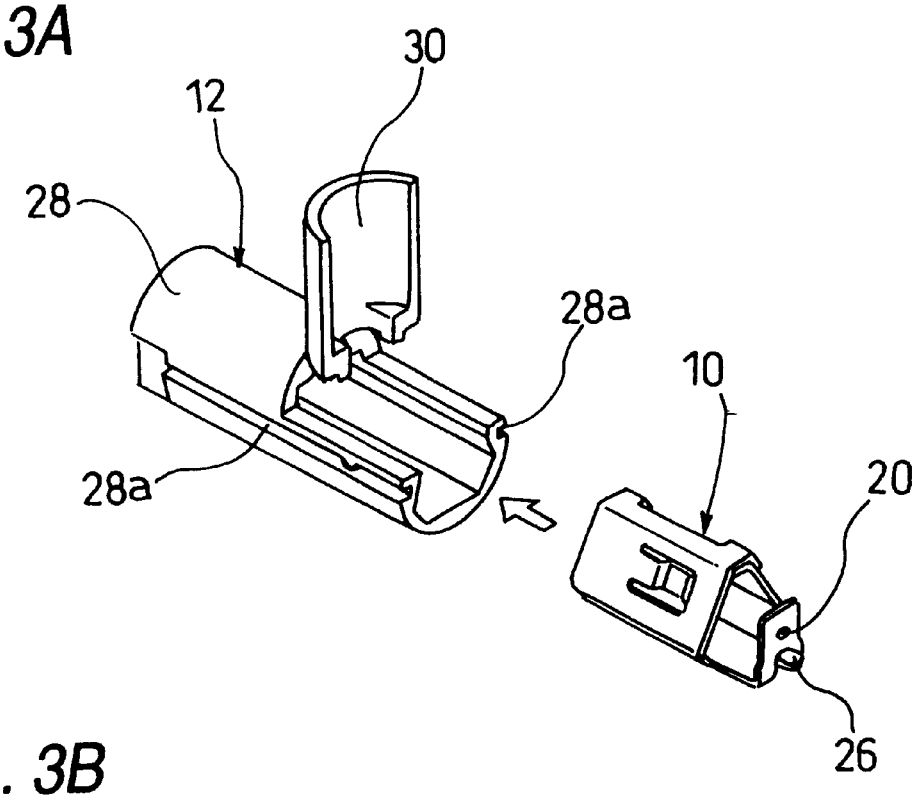
FIG. 3A is an exploded perspective view showing the terminal and a holder of the coaxial cable connector.
Figure 3B:
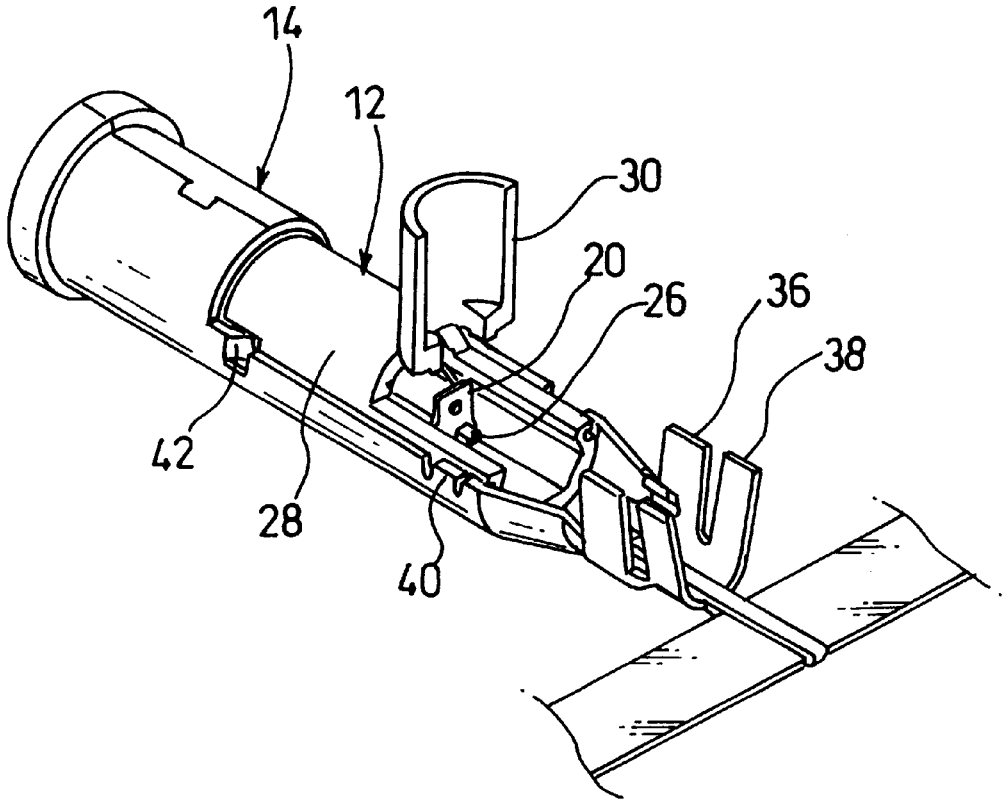
FIG. 3B is a perspective view showing the state in which the terminal and the holder are fitted into a sleeve.

FIG. 1 is a longitudinal sectional view of a coaxial cable connector (hereinafter, referred to as connector). FIG. 2A is a perspective view showing a terminal of the coaxial cable connector. FIG. 2B is a sectional view taken along the line A—A of FIG. 2A. FIG. 3A is an exploded perspective view showing the terminal and a holder of the coaxial cable connector. FIG. 3B is a perspective view showing the state in which the terminal and the holder are fitted into a sleeve. As shown in FIG. 1, a connector 100 according to the invention comprises a terminal 10, a tubular holder 12 in which the terminal is inserted for fixation, a sleeve 14 fitted over a half of the outer circumference of the holder 12, and in addition, a shield cover and an outer cover formed of an insulator, which will be described later.

The terminal 10 is prepared by pressing a metal having good conductivity such as copper, and as shown in FIG. 2, and it comprises a hollow part 16 formed substantially into a triangular prism, a bottom portion 18 extending to one of end portions of the hollow part 16, a vertical wall raised perpendicularly at a leading end of the bottom portion 18 as a solder joint surface, a core wire connection hole 22 opened in the vertical wall 20, an opening 24 opened at a transversely central portion in a lower portion of the vertical wall 20 for engaging with a lance 34 of the holder 12, which will be described later, and a table portion 26 formed at an upper end of the opening 24 by folding back part of the vertical wall 20 in such a manner as to project at right angles relative to the vertical wall 20.

In addition, formed in the hollow part 16 are a connector 16*a* stamped inwardly out of an inclined face of the terminal main body and an elastic contact piece 16*b* cut out of a bottom of the terminal main body so as to be raised therefrom, as shown in FIG. 2B.

The holder 12 is an injection molded body of a synthetic resin which is an insulator, comprises a cylindrical portion 28 which is a main body of the holder 12 and a lid 30 adapted to open an upper half portion of the holder 12 at one end thereof, and allows the terminal 10 to be inserted into the interior thereof.

Fixation grooves 28*a* are formed in the outer circumference of the cylindrical portion 28 of the holder at both sides thereof, and the lid 30 is made integral with the cylindrical portion 28 at the opening thereof via thin hinge 32. In addition, a flexible lance 34 is provided at a portion of the bottom of the holder 12 in such a manner as to project therefrom for fixing the terminal through elastic deformation, and the lance 34 is brought into engagement with the opening 24 in the terminal 10 when the terminal 10 is inserted into the holder 12, whereby the terminal 10 in the inserted state is positioned in place and is prevented from dislocation.

Thus, in the state in which the terminal 10 is inserted into the holder 12, as shown in FIG. 1, the vertical wall 20 of the terminal 10 is exposed to the outside when the lid 30 is opened.

The sleeve 14 is of a substantially cylindrical shape which is open at an upper half portion at one end thereof and comprises a pair of braided wire clamping pieces 36 and a pair of sheath clamping pieces 38 which are provided at the opening end thereof in such a manner as to project therefrom, holder positioning pieces 40 provided on the sleeve cylindrical portion in such a manner as to project inwardly of the sleeve for engagement with the grooves 28*a* of the holder 12 and holder engagement pieces 42 formed on a cylindrical body of the sleeve 14.

When the holder 12 is inserted into the sleeve 14, the holder 12 is positioned with the holder positioning pieces 40.

The connector 100 is assembled to the coaxial cable 50 after it is assembled to the above described state. Next, described will be a method for assembling the connector 100 to the coaxial cable 50.

Figure 4A:
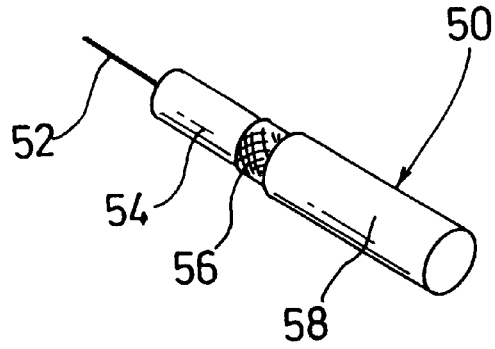
FIGS. 4A to 5D are perspective views showing a process for assembling the coaxial cable connector.

In this assembling procedure, as shown in FIG. 4A, for example, a peeling machine or the like is used to peel an outer sheath 58 off of a core wire 52, an inner sheath 54 and a braided wire 56 in that order to expose one end of the coaxial cable 50 at a predetermined longitudinal ratio.

Figure 4B:
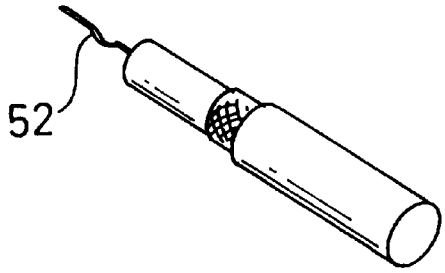

Next, as shown in FIG. 4B, the core wire 52 is pinched with a fixture so as to provide a wavelike bent portion (refer to FIG. 1).

Figure 4C:
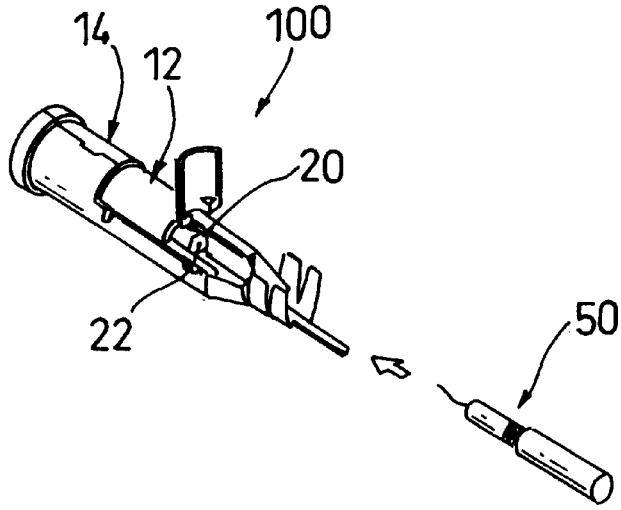
Figure 4D:
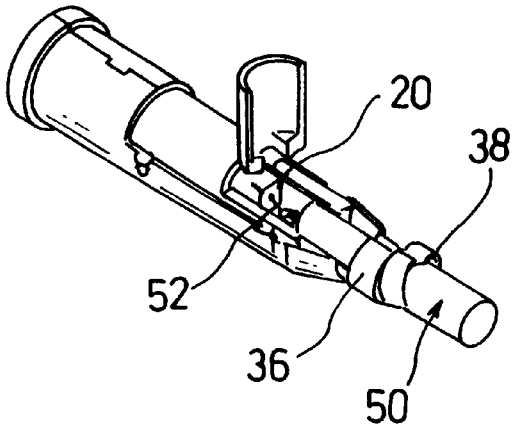

Then, as shown in FIG. 4C, the leading end of the coaxial cable 50 is inserted into the connector 100 assembled as described above. The leading end of the core wire 52 is allowed to pass through the connection hole 22 formed in the vertical wall 20 of the terminal 10. Here, as shown in FIG. 4D, the braided wire clamping pieces 36 and the sheath clamping pieces 38 are clamped together so as to hold the coaxial cable 50.

Figure 5A:
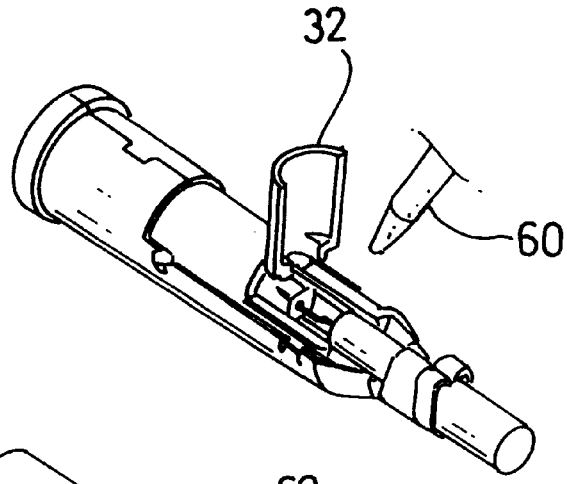

Next, soldering work is performed in this stage. In other words, as shown in FIG. 5A, the leading end of a soldering iron 60 is applied diagonally so as to press against the vertical wall 20 of the terminal 10 for soldering (refer to FIG. 1). When this takes place, the soldering iron 60 can stably be held by allowing the leading end of the soldering iron 60 to press against a comer portion between the vertical wall 20 and the table portion 26. This remarkably improves the workability in soldering and therefore remarkably reduces the frequency at which soldering failures take place. In addition, since solder which is surplus adheres to the table portion 26, there is no way that the solder so adhering sags off from the table portion 26, and therefore a risk of fusion of the holder 12 by the solder is avoided and a problem of short circuit that would be generated by such a short circuit is prevented.

Figure 5B:
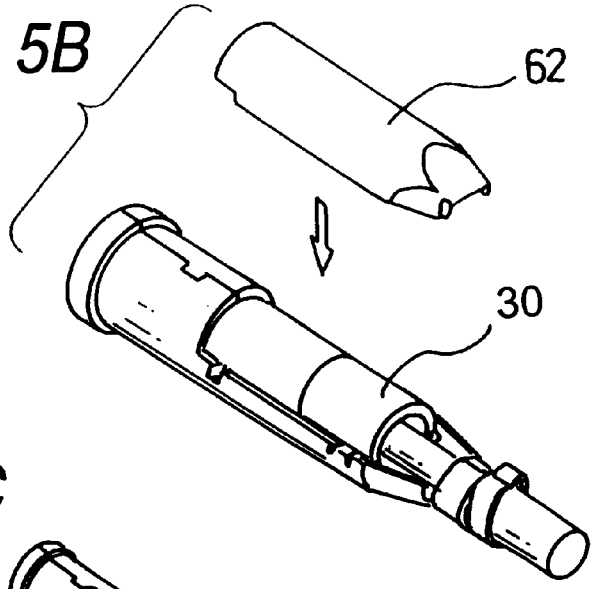
Figure 5C:
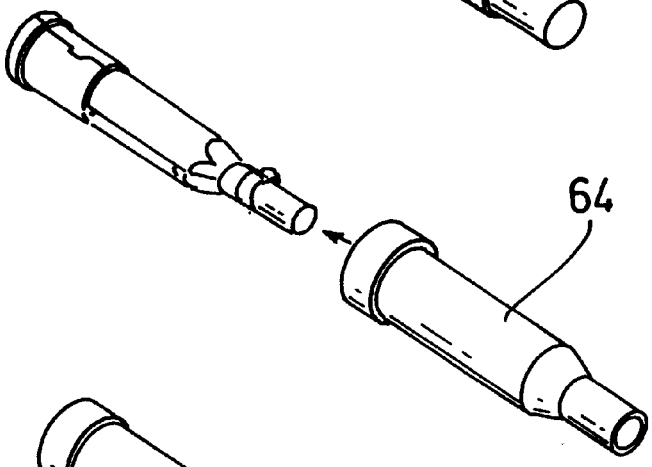
Figure 5D:
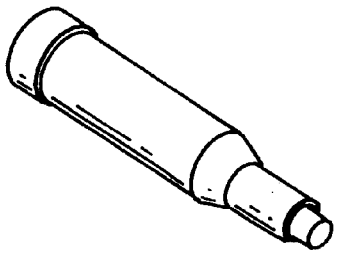
Figure 6:
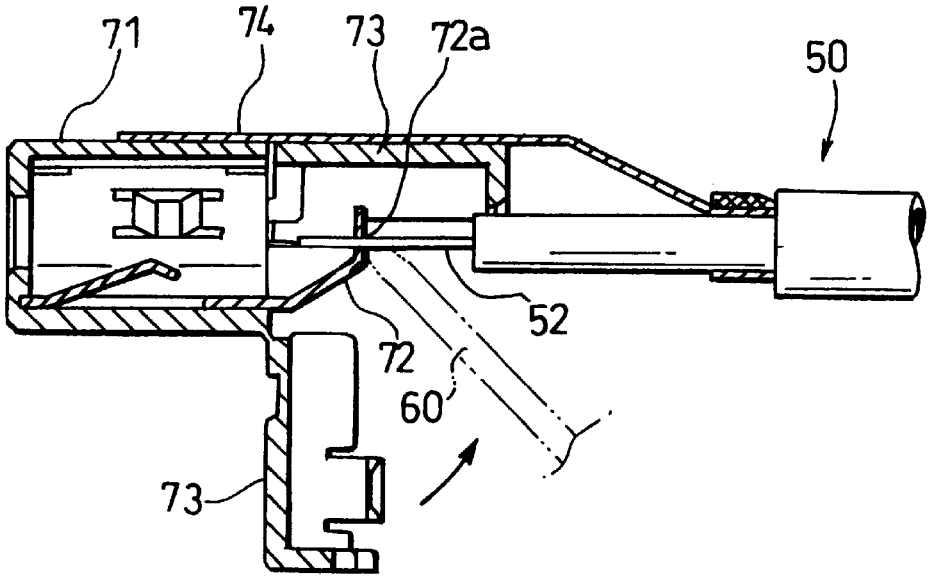
FIG. 6 is a sectional view showing a state in which soldering is performed in a related coaxial cable connector.
Figure 7:
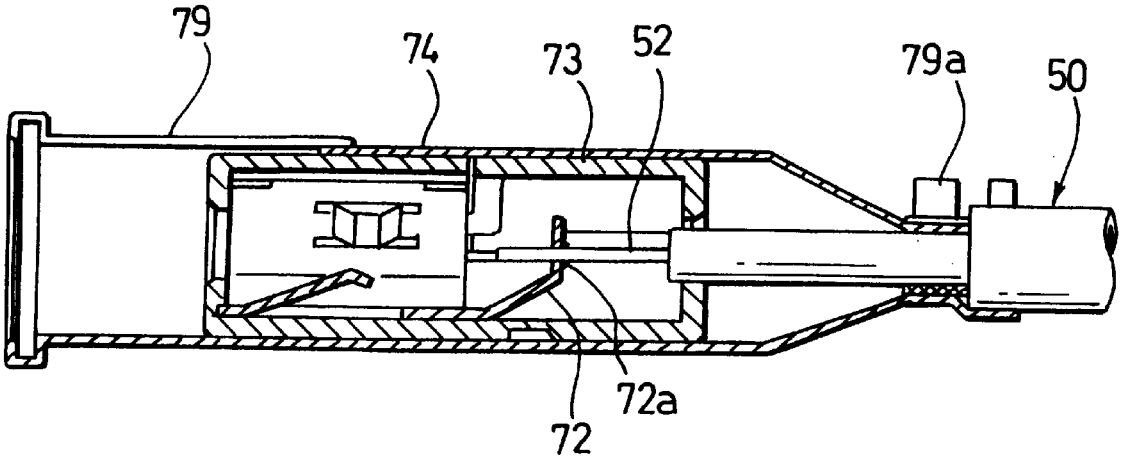
FIG. 7 is a sectional view showing a state in which the assembling of the related coaxial cable connector is completed.

After the soldering is completed, the lid 30 is closed, and as shown in FIG. 5B, the aforesaid shield cover 62 is placed over the holder 12. Then, as shown in FIG. 5C, the outer cover 64 comprising an insulator which has already been introduced onto the coaxial cable 50 is moved so as to mount on the outer circumference of the assembled connector, when the connector assembling work is completed as shown in FIG. 5D.

Here, since the table portion 26 of the terminal 10 is formed by folding back the part of the vertical wall 20 at right angles when the opening 24 is formed, there is no need to form a separate table portion 26, whereby a construction can be provided which is simple and free from wastefulness.

As has been described heretofore, with the coaxial cable connector according to the invention, by forming at the vertical wall 20 of the terminal 10 the table portion 26 which projects at right angles relative to the vertical wall 20 the leading end of the soldering iron 60 can be placed on the table portion 26 so formed in soldering the core wire 52 of the coaxial cable 50 to the core wire connection hole 22 of the terminal 10, whereby the soldering iron 60 can stably be held. Thus, the workability in soldering can be improved, whereby soldering work can be carried out quickly and with high quality. In addition, since fused solder accumulates at the table portion 26, sagging of solder is prevented, whereby short circuit attributed to the sagging of fused solder can be prevented.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector for a coaxial cable comprising:

a terminal including:

a connecting portion having a through hole to which a core wire of the coaxial cable is inserted to be electrically connected therewith; and a flat projection, formed from the connecting portion and projecting in a direction toward the coaxial cable, said flat projection being located in a vicinity of the through hole so as to capture excess solder when the core wire is soldered to said connecting portion; and a terminal holder made of an insulating material for accommodating the terminal.

2. The connector as set forth in claim 1, wherein the connecting portion includes a vertical wall member extending perpendicular to an insertion direction of the coaxial cable, and the flat projection is formed as a horizontal table member projected therefrom so as to extend parallel with the insertion direction of the coaxial cable.

3. The connector as set forth in claim 2, wherein a comer portion is defined by the vertical wall member and the horizontal table portion, wherein said comer portion receives a leading end portion of a soldering iron for soldering the connecting portion and the core wire is abutted.

4. The connector as set forth in claim 1, wherein the terminal holder includes a lid body for opening/closing a space where the connecting portion is located.

5. The connector as set forth in claim 4, further comprising a lid body connected to said terminal holder such that a space is formed by opening the lid body, thereby allowing a soldering iron to be inserted therein for soldering the connecting portion and the core wire.

6. A connector for a coaxial cable comprising:

a terminal including:

a connecting portion having a through hole to which a core wire of the coaxial cable is inserted to be electrically connected therewith; and a flat projection formed in the vicinity of the through hole on the connecting portion; and a terminal holder made of an insulating material for accommodating the terminal, wherein the connecting portion includes a vertical wall member extending perpendicular to an insertion direction of the coaxial cable, and the flat projection is formed as a horizontal table member projected therefrom so as to extend parallel with the insertion direction of the coaxial cable, wherein a part of the vertical wall member is cut and erected to form the horizontal table member; and wherein the terminal holder has a projection on an inner wall thereof, which is engaged with an opening formed on the connecting portion due to the formation of the horizontal table member.

* * * * *